US009675516B2

(12) United States Patent
Parsloe

(10) Patent No.: US 9,675,516 B2
(45) Date of Patent: Jun. 13, 2017

(54) MASSAGE APPARATUS AND METHOD OF USE

(75) Inventor: Colin Parsloe, Milton Keynes (GB)

(73) Assignee: Innovative Treatment Solutions Ltd., Buckinghamshire (GB)

( * ) Notice: Subject to any disclaimer, the term of this patent is extended or adjusted under 35 U.S.C. 154(b) by 767 days.

(21) Appl. No.: 13/380,420

(22) PCT Filed: Jun. 22, 2010

(86) PCT No.: PCT/GB2010/001218
§ 371 (c)(1),
(2), (4) Date: Mar. 15, 2012

(87) PCT Pub. No.: WO2010/149959
PCT Pub. Date: Dec. 29, 2010

(65) Prior Publication Data

US 2012/0165708 A1 Jun. 28, 2012

(30) Foreign Application Priority Data

Jun. 24, 2009 (GB) ..... 0910930.7

(51) Int. Cl.
*A61H 7/00* (2006.01)
*A61H 15/00* (2006.01)

(52) U.S. Cl.
CPC ..... *A61H 15/0092* (2013.01); *A61H 7/00* (2013.01); *A61H 7/002* (2013.01); *A61H 7/003* (2013.01);
(Continued)

(58) Field of Classification Search
CPC . A61H 5/00; A61H 7/00; A61H 7/003; A61H 7/004; A61H 7/005; A61H 7/007;
(Continued)

(56) References Cited

U.S. PATENT DOCUMENTS 810,885 A * 1/1906 Saighman ..... 601/19
1,664,009 A 3/1928 Weber
(Continued)

FOREIGN PATENT DOCUMENTS

DE 3610220 A1 * 10/1987 ..... A61H 15/0085
GB 453949 A * 9/1936 ..... A61H 15/0092
WO WO2009066077 A1 5/2009

OTHER PUBLICATIONS

Machine translation, "English Translation for DE 3610220A1", Patent Translate Powered by EPO and Google, translation captured on Mar. 30, 2016.*

*Primary Examiner* — Justine Yu
*Assistant Examiner* — Tu Vo
(74) *Attorney, Agent, or Firm* — Gable Gotwals

(57) ABSTRACT

The present invention relates to a device for therapeutic and/or prophylactic massage, in particular massage of mammalian eyelids, having a body housing a heater in thermal communication with a massaging bobbin, the bobbin having a plurality of massaging elements extending therefrom. In use, the bobbin heats the eyelid and rotates such that a massaging force is exerted on the eyelid perpendicular to the last line. This force can be used to express material from blocked sebaceous glands of the mammalian eyelid. The present invention is directed toward a method for treating disorders of the mammalian eyelid, such as inflammation, using the device of the invention.

10 Claims, 3 Drawing Sheets

(52) U.S. Cl.
CPC ..... *A61H 7/004* (2013.01); *A61H 7/005* (2013.01); *A61H 7/007* (2013.01); *A61H 15/00* (2013.01); *A61H 2015/0007* (2013.01); *A61H 2015/0028* (2013.01); *A61H 2201/0153* (2013.01); *A61H 2201/0157* (2013.01); *A61H 2201/0207* (2013.01); *A61H 2201/12* (2013.01); *A61H 2201/1207* (2013.01); *A61H 2201/1215* (2013.01); *A61H 2205/024* (2013.01)

(58) Field of Classification Search
CPC ..... A61H 2205/00; A61H 2205/024; A61H 15/02; A61H 2201/0157; A61H 2201/0207; A61H 2015/0007; A61H 2015/0014; A61H 2201/0221; A61H 2201/0228
USPC ..... 601/1, 15, 17, 18, 19, 21, 46, 84, 102, 601/112, 113, 118, 119, 120, 121, 12, 601/125, 126, 136, 137, 138, 122, 139
See application file for complete search history.

(56) References Cited

U.S. PATENT DOCUMENTS 1,710,051 A * 4/1929 Giacopazzi ..... 601/127
1,820,895 A 8/1931 Weber
1,872,832 A * 8/1932 Silverberg ..... A61H 13/00 15/188
1,969,042 A * 8/1934 Senn ..... A61H 15/0092 15/188
D102,072 S * 11/1936 Woodside ..... D24/211
2,219,138 A * 10/1940 Morrison ..... A61H 15/0078 601/125
2,230,890 A * 2/1941 McClenathen ..... A61H 15/00 482/79
2,515,524 A * 7/1950 Manzel ..... A61H 15/0092 601/119
2,546,095 A * 3/1951 Gustlin ..... A61H 15/02 165/177
2,699,164 A * 1/1955 Stauffer ..... 601/118
D181,186 S * 10/1957 Conrad ..... D24/211
3,037,500 A * 6/1962 Daugherty ..... A61H 15/00 482/79
D202,534 S * 10/1965 McNair ..... D21/662
3,313,296 A * 4/1967 Ruuska ..... A61H 15/0085 601/125
D224,946 S * 10/1972 De Ramel ..... D24/211
D225,907 S * 1/1973 Shiu ..... D24/211
D230,323 S * 2/1974 Possick ..... D24/211
3,884,232 A * 5/1975 Braun ..... A61F 9/0008 132/333
4,014,325 A 3/1977 Clarke
4,046,142 A * 9/1977 Whitney ..... 601/108
4,554,911 A * 11/1985 Nielsen ..... A61H 15/0092 132/333
4,565,189 A * 1/1986 Mabuchi ..... A61H 23/0254 601/93
5,152,281 A * 10/1992 Koll ..... A61H 15/0092 601/118
5,643,182 A * 7/1997 Engel ..... A61H 15/0092 601/119
5,690,608 A * 11/1997 Watanabe et al. ..... 601/19
5,709,705 A * 1/1998 Belcher ..... A61H 15/0092 601/120
5,997,489 A 12/1999 Iwamoto et al.
6,544,201 B1 * 4/2003 Guitay ..... 601/6
7,918,774 B2 * 4/2011 Dye ..... 482/132
2003/0004441 A1 * 1/2003 Jelenc ..... 601/15
2005/0131320 A1 * 6/2005 Lee ..... A61H 15/0092 601/119
2007/0016254 A1 1/2007 Grenon et al.
2007/0016256 A1 * 1/2007 Korb et al. ..... 607/1
2008/0109053 A1 * 5/2008 Grenon et al. ..... 607/109
2008/0154161 A1 * 6/2008 Abbott ..... 601/113
2008/0154162 A1 * 6/2008 Thiebaut ..... 601/125

* cited by examiner

MASSAGE APPARATUS AND METHOD OF USE

RELATED APPLICATIONS

This application is the U.S. National Phase of International Application No. PCT/GB2010/001218, filed Jun. 22, 2010, published in English, which application claims priority under 35 U.S.C. §119 or 365 to Great Britain Application No. 0910930.7, filed Jun. 24, 2009. The entire teachings of the above applications are incorporated herein by reference.

FIELD OF THE INVENTION

The present invention relates to an improved apparatus for therapeutic and/or prophylactic massage and methods for use of said apparatus. Particularly, although not exclusively, the present invention relates to a device and methods for using such a device for therapeutic and/or prophylactic massage of mammalian eyelids.

BACKGROUND

The eye condition, 'Blepharitis', is an inflammation of the eyelids characterised by red, irritated and/or itchy eyes. It is frequently caused by bacterial infections but is also associated with skin conditions such as acne rosacea and dandruff of the scalp. There are two distinct forms of this condition that may occur concurrently: anterior blepharitis which is characterised by inflammation of the eyelid at the base of the eyelashes and posterior blepharitis, which describes inflammation of the modified sebaceous glands of the eyelid.

The modified sebaceous glands secrete an oily compound that contributes to the tear film of the eye. This secretion has various functions including:

1) Prevention of tear overflow;
2) Formation of a watertight seal on the closure of the eyelids;
3) Prevention of maceration of the lid-margin skin by tears;
4) Retardation of evaporation of the tear film;
5) Prevention of contamination of the tear film by the secretions of unmodified skin sebaceous glands;
6) Lowering the surface tension of tears resulting in thickening of the aqueous phase; and
7) Providing a smooth surface for the refraction of light.

Inflammation of the modified sebaceous glands is linked to a change in the lipid content or hyperkeratinisation of the gland's central duct. Changes such as these may be triggered by factors such as increasing age or alterations to a person's diet or hormone levels. Both of these underlying pathologies result in the obstruction of the outflow from the duct. If the gland is blocked it may swell up and cause a painless lump on the eyelid, or this swollen gland may become infected resulting in a painful red pustular mass in the eyelid. Eventually the gland becomes fibrosed and is permanently destroyed. Fibrosed glands often result in a loss of the normal anatomy of the eyelids resulting in increased tear film instability and eyelashes may become misdirected resulting in them growing towards the cornea causing a great deal of irritation to the patient. Loss of function and eventual loss in the number of glands results in a reduction in the oil component of the tear film. This is a leading cause of dry eye syndrome.

Known methods for treating the inflammation of the modified sebaceous glands include the application of hot compresses and subsequent manipulation of the eyelid. The hot compress "melts" or substantially decreases the viscosity of the modified sebum build up within the gland and subsequent massage may be effective in expressing the less viscous modified sebum from the gland. There are obvious drawbacks associated with this method, such as:

1) contamination by unsterilised items touching the eye and potentially worsening any infection already present;
2) potentially overheating the eye causing damage and discomfort;
3) not applying sufficient heat to treat the disease resulting in high recurrence and poor compliance; and
4) not massaging the lids for a sufficient amount of time or using an ineffective massage action.

Prior art devices designed for use on the eyelids include devices that either apply heat or massaging or a combination of heat and massaging to the lids. These limited steps effectively only deal with the blocked modified sebaceous glands. However, additional treatments designed to cleanse and remove debris from the eyelashes are often required. Furthermore, it is known that treating anterior blepharitis at the same time as posterior blepharitis leads to a reduction in the recurrence of posterior blepharitis.

Known methods for scrubbing the lashes are either the use of cotton wool or a woven cloth like material. Patients are often asked to make their own concentrate mixture of an un-medicated soap solution.

The complex regime of applying hot compresses, massaging the eyelid and cleansing the lashes often results in poor patient compliance. It takes time to perform each function correctly and a good level of dexterity is required. As blepharitis occurs more commonly in older patients, these technical challenges can result in even lower rates of patient compliance.

In addition, the fact that the treatment regime consists of multiple functions increases the likelihood that patients will only adequately treat one element of their disease, for example the blocked sebaceous glands. Only treating one element of the disease can result in much higher recurrence rates and therefore greater potential for the long-term loss of the limited number of glands in the eye.

The inventors have previously identified the need to treat the multiple elements of blepharitis simultaneously in order to improve patient compliance and reduce disease recurrence. A device for heating and massaging the eyelid with concomitant scrubbing of the lash bases is disclosed in patent application number WO 2009/066077. However, this particular art-known massaging apparatus is expensive to manufacture due to its complexity and has some other drawbacks which the present invention aims to ameliorate.

One of the drawbacks of the prior art device is inefficient heat transfer from the heating element to the surface in contact with the eyelid. As a result, the apparatus needs to be heated to high temperatures in order to transfer sufficient heat to the eyelid. The inefficient heat transfer also means the apparatus requires a few minutes to attain the required temperature prior to use, which significantly increases the overall time required to perform the treatment. In addition, this shortcoming necessitates a microchip controller and an alarm system to alert the end-user to when the device is ready thereby increasing the manufacturing costs of the apparatus.

Furthermore, a high amount of energy is required to power the prior art device. This either means that batteries need to be changed extremely frequently or the device needs to be connected to mains power in use. This results in high running costs resulting potentially poor patient compliance or expense for inclusion of mains power chord.

The prior art device has a massaging nodule that describes a circular path therefore in order to treat both halves of the eyelid in the desired direction, the massaging apparatus needs to alternate between rotating clockwise and rotating anticlockwise during a single treatment. This necessitates either a manual or an automatic switch to reverse the direction of the motor and alternate the rotation of the massaging nodule, incurring additional cost in manufacture.

It is an object of the present invention to provide a device that overcomes the shortcomings of the prior art devices, and in particular, to reduce manufacturing costs and make it easier for patients to use.

It is also the object of the present invention to provide a device with an improved massaging action to more effectively treat inflammation of the eyelid and reduce recurrence, or at least to provide the public with a useful alternative.

STATEMENT OF INVENTION

In a first aspect, the present invention provides an apparatus for melting and expressing material from blocked glands in a mammalian eyelid having a body housing a heater in thermal communication with a massaging bobbin having a plurality of massaging elements extending therefrom so that, in use, the bobbin heats the eyelid and rotates so that the massaging elements move parallel to the lash line across the eyelid and characterised in that the massaging elements are shaped and positioned on the bobbin so that they exert a massaging force perpendicular to the lash line to express material from the glands.

The body may be made of any material suitable for housing the components of the apparatus. In preferred embodiments the body is made from a thermo-insulating material such as rubber or plastic.

In preferred embodiments the body comprises a handle sized so as to fit in the palm of the hand. In a particularly preferred embodiment the handle has a grip portion for ease of handling.

In another preferred embodiment, the body houses a motor to drive the rotation of the massaging bobbin. The motor may be any device that converts an electrical current into mechanical energy such as a DC motor or AC motor or any other motor known in the art. In one particularly preferred embodiment, the electric motor is a standard DC motor.

Where the words parallel, perpendicular and horizontal are used with respect to the arrangement of parts either on the device or positioning when the device is in use, those terms are to be construed to mean parallel enough, perpendicular enough and horizontal enough to carry out the specified purpose.

In preferred embodiments, the device also includes a power supply, which may supply alternating current (AC) or direct current (DC). The apparatus according to the present invention may be powered by one or more batteries or may be mains powered. Where the power is supplied by batteries, these may be housed in the body of the apparatus and may be disposable or rechargeable. Rechargeable batteries may be recharged inside the apparatus or may be removed and charged separately.

In yet another preferred embodiment, the device includes a time-dependent switch configured to switch off the power supply after a set period.

The heater may be any device capable of transferring heat to the massaging bobbin such as an electric resistive element or any similar device. In preferred embodiments, the heater is an electric resistive heater.

In a preferred embodiment, the heater is positioned inside the body near to the massaging bobbin so that heat is transferred to the outer surface of the bobbin. In a particularly preferred embodiment, heat is transferred from the heater to the massaging bobbin via a thermally conducting material such as a metal. In yet another embodiment, the heater is positioned inside and preferably through the central core of the massaging bobbin and heats the massaging bobbin from within.

In particularly preferred embodiments, the heater is an electric resistive heater with a positive temperature coefficient. This gives the additional advantage that a thermostat is not required, thus reducing the cost of the apparatus. It may also be set at a predetermined temperature and is therefore much safer, preventing accidental overheating of the device and the eye. It may be that during use the device's settings can be altered. However, the above heating mechanism removes the requirements for elaborate adjustments and complicated control systems. This means that there is no need for a third party such as an ophthalmic professional to be present during the treatment.

The massaging bobbin may be made of any material capable of exerting a massaging force on the eyelid. In one embodiment, the massaging bobbin is made of a deformable material that, when pressed against the eyelid, moulds to match or approximate the contours of the eyelid. In preferred embodiments, the massaging bobbin is made from rubber, synthetic rubber, silicone rubber or like materials.

In preferred embodiments, the massaging bobbin is made from a heat absorbent material. More preferably, the heat absorbent material is thermally conductive rubber.

In preferred embodiments, the massaging bobbin is substantially cylindrical in shape or substantially concave cylindrical, that is as a cylinder with a waist or reduced cross section. In a particularly preferred embodiment, the massaging bobbin measures about 3 cm in height and 2 cm in diameter. The vertical edges of the preferred concave cylindrical massaging bobbin may be concave so as to match or approximate the contours of the eyelid.

The massaging elements may comprise any elevated region(s) on the surface of the massaging bobbin positioned so that, in use, they exert a massaging force perpendicular to the lash line. In a preferred embodiment, the massaging elements comprise a plurality of continuous narrow ridges extending around the periphery of the massaging bobbin in a generally helical configuration. In another preferred embodiment, the massaging elements comprise discontinuous protrusions extending around the periphery of the massaging bobbin in a generally helical configuration. In a particularly preferred embodiment, the massaging elements comprise upper and lower ridges adapted to massage the upper and lower eyelids respectively wherein said ridges converge or overlap at the junction of the lower and middle third of the massaging bobbin.

In use, the massaging bobbin is able to rotate in one direction, to rotate in the opposite direction, or is able to alternate between rotating in either direction during a single treatment.

In a preferred embodiment, the massaging bobbin rotates in a single direction during a single treatment. As the massaging bobbin rotates, the massaging elements move across the eyelid creating a massaging force perpendicular to the lash line. The transfer of pressure from the tip of the glands most distal to the lash line to the opening of the glands at the lash line facilitates the expression of material from the glands.

The massaging bobbin may rotate at any speed preferably rotating about once every 5 to 15 seconds. In a particularly preferred embodiment, the massaging bobbin rotates at approximately one revolution every ten seconds. Because of the simplified design, the bobbin may rotate higher in the preferred range initially when the batteries are fully charged and move toward the lower end of the range as the battery discharges. A particularly preferred, albeit slightly more expensive, embodiment may have electronics that ensure the bobbin rotates at the same speed regardless of battery charge state.

In yet another preferred embodiment, the massaging bobbin is coated with a fluid such as a silicone lubricant.

In one embodiment, the massaging bobbin comprises a plurality of scrubbing elements so that, in use, the said elements displace debris from the base of the lashes. In a preferred embodiment, the scrubbing elements comprise a plurality of finger-like projections. In a particularly preferred embodiment, the projections are positioned around the junction between the lower and middle third of the massaging bobbin and run concentrically around the circumference of the bobbin. In use, the finger-like projections at this position engage with the eyelashes to dislodge debris clinging thereto.

In yet another preferred embodiment, the body and/or bobbin is adapted so that the massaging bobbin can be detached from the body of the apparatus of the invention and disposed of after each treatment session.

In a second aspect, the present invention also provides a method for treating inflammation of eyelid glands in a patient in need thereof comprising using the apparatus according to the present invention.

In preferred embodiments, the method of the invention is carried out by treatment of the eyelid twice per day for two weeks. Particularly preferably the method subsequently involves a daily maintenance treatment on a permanent basis.

In preferred embodiments, the method of the invention is carried out from about 1 to about 5 minutes per eye per day. More preferably the method of the invention is carried out around 3 minutes a day per eye per day.

In one particularly preferred embodiment of the method of the invention the bobbin is detached and may be cleaned or disposed of, before the other eye is treated. This additional step ensures that cross-contamination of eyes is at least limited.

In a third embodiment the invention provides a massaging bobbin adapted for use in the apparatus of the invention. In preferred embodiments the invention provides a kit comprising one or more bobbins for use in the apparatus of the invention and, optionally, a lubricating liquid applied thereto or supplied in a separate container, packaged together, preferably in a hermetically sealed package. Preferably everything in the hermetically sealed package is sterile. A sterilisation step can be carried out either before the package is sealed or afterward and may involve radiation treatment, chemical treatment, heat treatment or any other sterilisation treatment known to one of skill in the art.

BRIEF DESCRIPTION OF THE DRAWINGS

The invention will now be described by way of example with respect to the accompanying drawings in which.

DESCRIPTION

Figure 1:
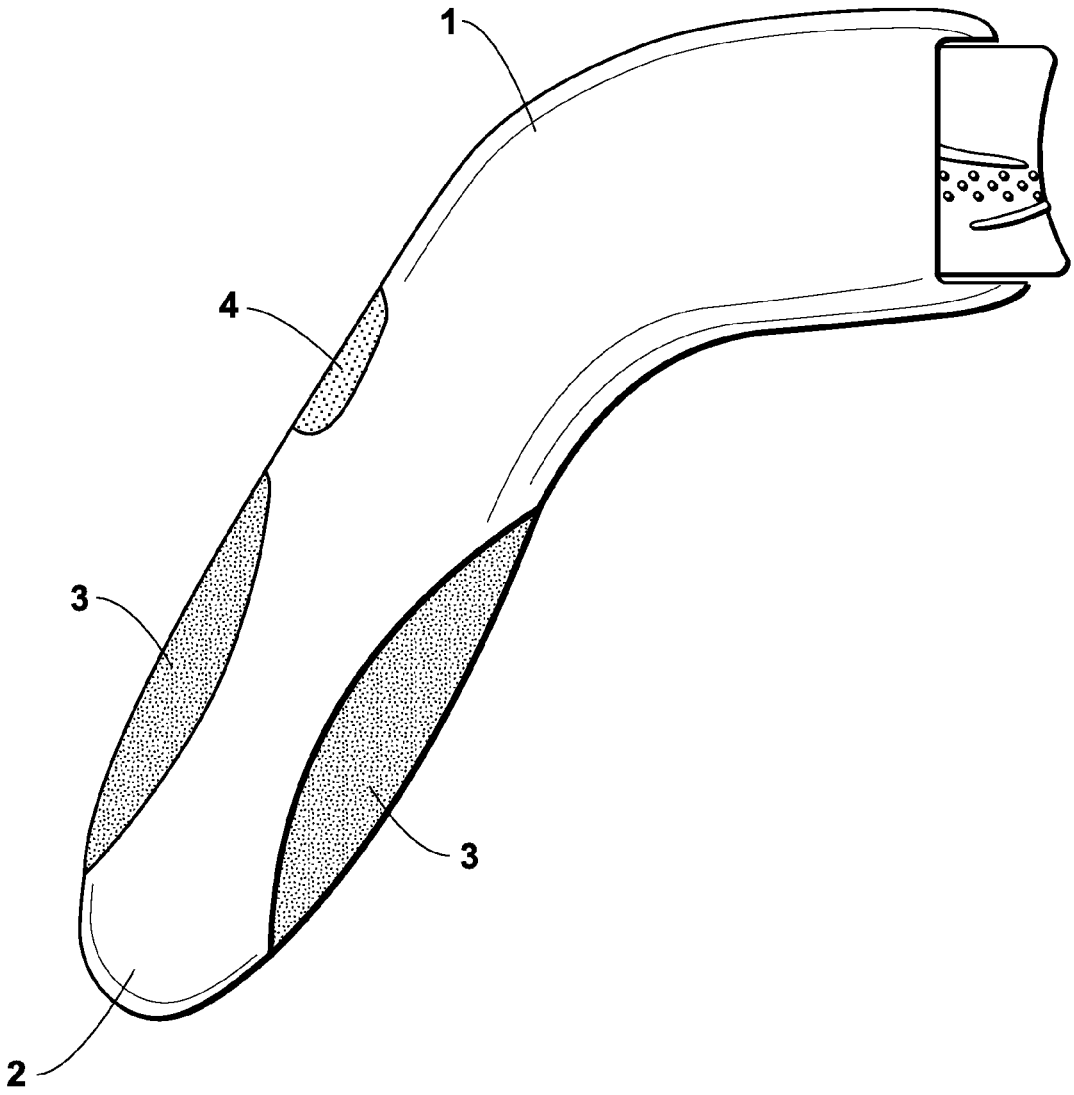
FIG. 1 shows a side view of the device according to a preferred aspect of the invention.

FIG. 1 shows an apparatus according to a preferred aspect of the present invention. The apparatus comprises a body (1) having an ergonomically-designed handle (2) with a grip portion (3) and having a switch incorporated into the handle for turning the device on and/or off (4). In some embodiments (not shown) the switch may automatically turn off after a predetermined time, for example 3 or 5 minutes. In some embodiments there may be other indicator instruments, for example to indicate remaining battery life.

Figure 2:
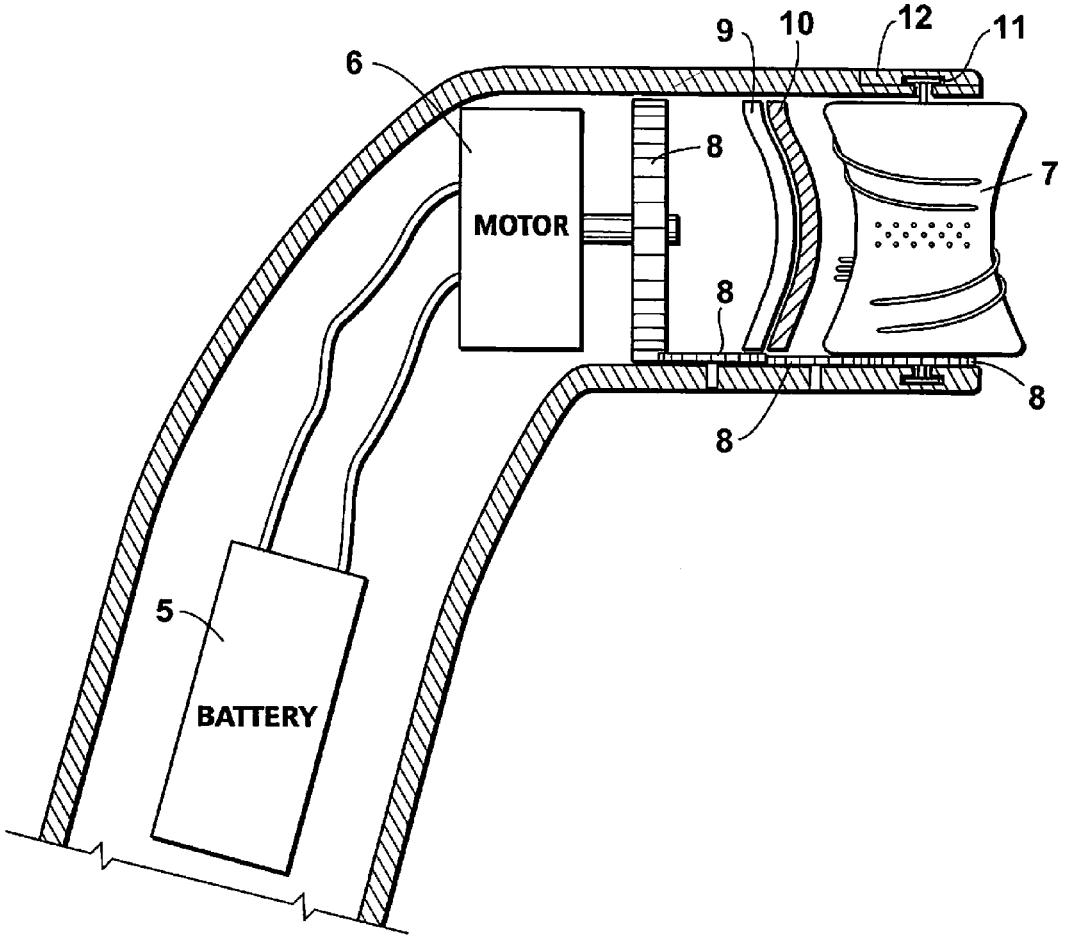
FIG. 2 shows a view of the upper end of the embodiment as shown in FIG. 1, shown in partial cross-section and illustrating how the bobbin is secured to the housing. The bobbin not being shown in cross section.

FIG. 2 shows the apparatus according to a preferred embodiment similar to that shown in FIG. 1 where a cross-sectional view through the device is now presented. The handle portion encloses a non-rechargeable or rechargeable battery (5) which is connected to an electric motor (6) in the form of a direct current (DC) motor. The motor is connected to the massaging bobbin (7) via a series of gears (8) so that, in use, the massaging bobbin rotates so that a point on its surface moves parallel to the lash line when viewed in the horizontal plane. The bobbin of the device shown rotates around an axis in use that is perpendicular to both the lash line and to the horizontal axis of the eye that intersects the pupil.

The heater (9), in the form of a positive temperature coefficient resistive heater, resides within the body of the apparatus in thermal communication with the massaging bobbin. An optionally thermally conductive insert (10) is positioned between the positive temperature coefficient heater and the massaging bobbin to effect heat transfer from the heater to the massaging bobbin, and thereafter to the patient's eyelid in use. This preferred embodiment is particularly advantageous as it facilitates efficient heat transfer from the heater to the massaging bobbin thereby ensuring the bobbin reaches the required temperature within seconds of switching the device on. The energy efficiency of this configuration also means that the heater need only reach a maximum temperature of around 50-60° C. in order to heat the massaging bobbin to the required temperature for use. The heat needent necessarily conduct through the bobbin but the heated portion is rotated around to make contact with the eye in a continuous manner in use.

In the particular embodiment shown in FIG. 2, the casing of the body surrounding the internal components of the device according to the invention has two indentations (11) opposed diametrically so that a disposable massaging bobbin, having protrusions positioned so as to index with the indentations, can be fitted for use and removed after use. In the preferred embodiment shown, the casing of the body has a pivoting retainer clip (12), shown in a first position which retains the bobbin and which may be moved to a second position to facilitate the release of the disposable massaging bobbin.

It is envisaged that the patient will purchase sealed sterile massaging bobbins separately or in a set with or without lubricant, fit them to the device of the invention and then discard them after use. Once discarded the bobbins may be collected and sterilised for further use and resale in packs. This avoids cross-contamination between eyes and between patients.

Figure 3:
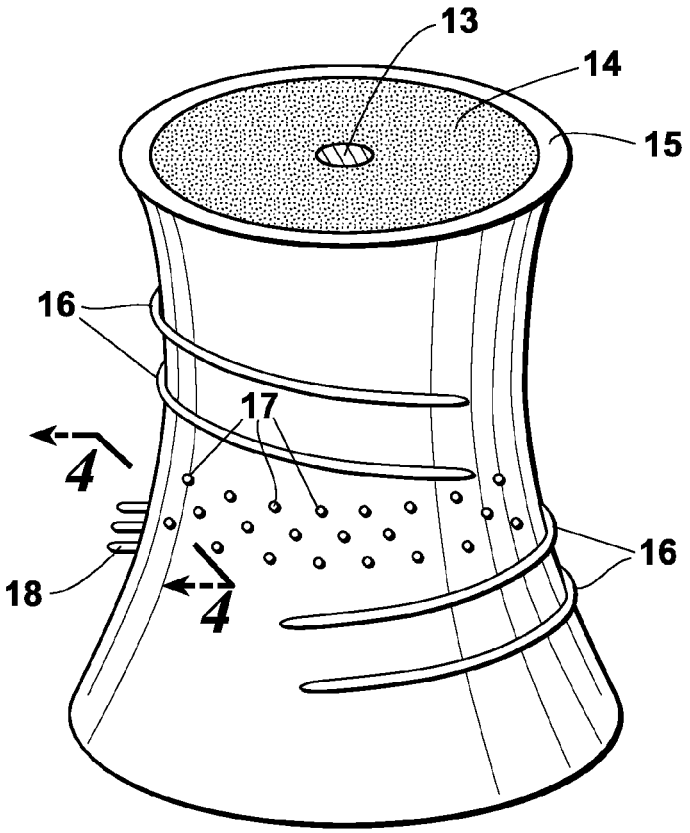
FIG. 3 shows a preferred embodiment of a massaging bobbin for use in the apparatus of a preferred embodiment of the invention.

FIG. 3 shows a massaging bobbin according to a preferred embodiment of the present invention having a substantially cylindrical shape with concave vertical edges to match the natural contours of the eye. The size according to this preferred embodiment measures about 30 mm in height and 20 mm in diameter at the widest point(s). The massaging bobbin in the form shown comprises three layers: the central frame (13), the internal core (14) and the outer cortex (15). The central frame may be made of any material capable of providing a firm structural core to the massaging bobbin. In a preferred embodiment of the invention, the gear cogs connect the DC motor to the massaging bobbin through contacting the central frame of the bobbin. The internal core may be made of any material suitably pliable so as to fit snugly around the central frame. The internal core may provide the deformability necessary so that, in use, the massaging bobbin achieves maximal contact with the eyelid in order to facilitate both heat transfer to the eyelid and effective massaging action. The outer cortex may be made any material firm enough to exert the desired massaging force on the eyelid. It may also be coated with a fluid, for example a lubricant or pharmacological preparation such as, for example, those containing anti-inflammatories, analgesics, anti-infectives and any other pharmaceutically active compounds which, when applied to the eyelid, may assist in the reduction of symptoms. The fluid may also facilitate the absorption of heat by the massaging bobbin and thereby improve heat transfer to the eyelid.

The outer cortex comprises a plurality of massaging elements (16), shaped and positioned on the bobbin so that, in use, they exert a massaging force perpendicular to the lash line to express material from the glands.

In the preferred embodiment shown in FIG. 3, the massaging elements (16) comprise continuous narrow ridges extending laterally around the periphery of the massaging bobbin, wherein the massaging elements adopt a generally helical configuration. FIG. 3 shows massaging elements having one upper ridge and one lower ridge positioned so as to converge at the junction of the lower and middle third of the massaging bobbin. In another embodiment (not shown), the upper and lower massaging elements may overlap at the junction of the lower and middle third of the massaging bobbin. Other massaging bobbin designs will occur to the skilled man and these are within the scope of the invention.

The embodiment shown in FIG. 3 is particularly advantageous because as the massaging bobbin rotates, pressure exerted by the massaging elements on the eyelid is transferred from the tip of the glands most distal to the lash line to the opening of the glands at the lash line. This massaging force perpendicular to the lash line ensures that the modified sebum build-up within the blocked gland is pushed towards the opening of the gland thereby facilitating expression of material from the gland. Of course, one of skill in the art will immediately recognise that other arrangements regarding shape and positioning of the massaging elements are possible to achieve the advantages of the invention and such arrangements are intended to be included within the scope to the invention.

The preferred embodiment of FIG. 3 shows a massaging bobbin having scrubbing elements (17) attached thereto. The scrubbing element comprises a plurality of deformable finger-like projections positioned around the junction of the lower and middle third of the massaging bobbin. In use, the scrubbing element contacts the base of the eyelashes and moves so as to dislodge any debris which has accumulated. The scrubbing element may contact the base of the lashes of both the upper and lower eyelids.

Figure 4:
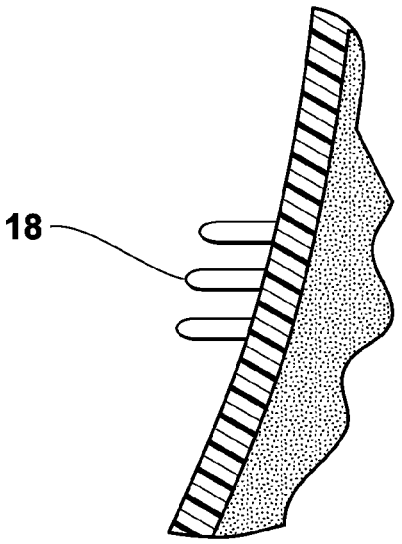
FIG. 4 shows a magnified view of a cross section through a preferred embodiment of a massaging bobbin for use in the apparatus of a preferred embodiment of the invention.

FIG. 4 shows a magnified view of a massaging bobbin at the junction of the lower and middle third according to the preferred embodiment of the invention shown in FIG. 3. As shown, the scrubbing element is in the form of 'fingers' (18) having a substantially circular cross section and extending so as to engage the base of the eyelashes in use but not so long as to penetrate the eyelids potentially causing damage to the cornea. The size may be in the order of a few millimeters, preferably around 2-4 mm long and around 1-1.5 mm diameter. Of course, other arrangements that achieve the advantages of the invention are intended to be included within the scope of the invention.

The method of the invention involves using the apparatus according to the present invention. The apparatus can be used regularly, for example every day, or relatively irregularly, for example when symptoms begin to develop.

In one particular method, the apparatus is used twice daily for two weeks after the initial symptoms develop and then once daily, each treatment episode lasting for a period of around 3 minutes per eye.

Daily treatment will ensure that the glands remain unblocked and will prevent the premature onset of damage by hyperkeratosis caused by aging and will prevent or at least delay the onset of dry eyes in a subject.

The treatment method takes into consideration that the therapeutic approach comprises two phases: an acute phase lasting two weeks, and a maintenance phase lasting indefinitely. During the acute phase, warm compress and expression of the glands needs to be performed twice a day. Lid scrubbing can be performed numerous times during the day.

The preferred embodiments of the apparatus and method of the invention described herein may demonstrate a number of advantages over known devices and methods, such as:

- The ability to treat two inflammatory conditions in one sitting leading to higher patient compliance due to ease of use;
- Less likelihood of over heating the eyelid;
- Less likelihood of mechanical damage to the eyelid and eye by applying the correct method of massaging to express the contents of the glands;
- Ensuring that the heat and the massaging are applied to the correct tissue preventing unnecessary heating of the skin of the face around the eyes;
- More effective cleaning of eyelid and lash bases;
- More rapid reduction of symptoms;

The device described herein is a single unit that simultaneously performs multiple functions required to treat inflammatory conditions of the eye thereby reducing the complexity of the treatment regime required. In contrast to prior art devices, the apparatus of the invention combines an effective massaging action with a much simplified overall design. By simplifying the design, the costs of manufacturing the device are significantly reduced. Furthermore, the simplified device will likely have a greater lifetime and can be repaired more easily should this be required.

The simplified design also improves the ease with which a patient can use the device. In particular, this device can be used in the comfort of the patient's own home and does not need to be used under the supervision of a medical professional such as an ophthalmic specialist. These advantages will result in greater patient compliance and more successful treatment of the condition. The improved massaging action will also contribute to a more rapid reduction in symptoms and decrease the likelihood of recurrence. In the long term, this will improve the survival and function of the body's natural glands and protect the eye from the complications associated with chronic forms of this condition. Furthermore, the disposable massaging bobbin reduces the risk of contamination and thereby the chances of sustaining further damage to the eye.

In the most preferred embodiment of the invention the concave massaging bobbin having both scrubbing elements positioned around, and massaging elements converging at a line around the bobbin about two thirds down from the top of the bobbin in use provides a particularly effective massage and scrubbing action with the absolute minimum of engineering complexity. Using the particularly preferred device provides a massaging action that is always toward the lash line and so is always expressing the gland toward its opening while the massaging finger-like projections sweep any detritus away from the lashes and can also help remove any expressed material.

Although the present invention has been described with respect to certain preferred embodiments this is intended in no way to limit the scope of the accompanying claims.

The invention claimed is:

1. An apparatus for melting and expressing material from blocked glands of a user having a mammalian eyelid, said apparatus comprises:

a body housing a heater to transmit heat to a massaging bobbin and housing a motor to rotate the massaging bobbin;

the massaging bobbin having a plurality of massaging elements extending therefrom and having a plurality of scrubbing elements and being substantially concave cylindrical in shape;

the plurality of massaging elements comprise a plurality of continuous narrow ridges extending around the massaging bobbin in a generally helical configuration, the plurality of continuous narrow ridges comprise upper and lower ridges, the plurality of scrubbing elements being positioned between the upper and lower ridges, wherein the plurality of massaging elements are configured to be applied in contact with the mammalian eyelid and shaped and positioned on the massaging bobbin to be adapted to exert a massaging force in a direction perpendicular to a lash line to express material from the blocked glands; and when in use, the massaging bobbin transmits heat to the mammalian eyelid and rotates so that the massaging elements move in a direction parallel to a lash line across the mammalian eyelid.

2. The apparatus of claim 1, wherein the massaging bobbin measures about 3 cm in height and 2 cm in diameter.

3. The apparatus of claim 1, wherein the substantially concave cylindrical massaging bobbin is configured to match or approximate contours of the mammalian eyelid.

4. The apparatus of claim 1, wherein the scrubbing elements comprise a plurality of elongated projections having a substantially circular cross section.

5. The apparatus of claim 1, wherein the scrubbing elements are located substantially in an area in a lower to middle third of the massaging bobbin and run concentrically around the massaging bobbin.

6. The apparatus of claim 1, wherein the massaging bobbin is made from a heat absorbent material.

7. The apparatus of claim 1, wherein the massaging bobbin is detachable from the body and disposable.

8. A method for treating inflammation of an eyelid in a patient in need thereof, said method comprising the following steps:

heating the eyelid by contacting an apparatus having a body including a heater, a motor and having a massaging bobbin configured to contact a curvature of the eyelid;

rotating the massaging bobbin being substantially concave cylindrical in shape and having massaging elements and scrubbing elements located on the massaging bobbin, the massaging elements comprising a plurality of continuous narrow ridges extending around the massaging bobbin in a generally helical configuration, the plurality of continuous narrow ridges comprising upper and lower ridges, the scrubbing elements being positioned between the upper and lower ridges, wherein the plurality of massaging elements are configured to be applied in contact with the eyelid and shaped and positioned on the massaging bobbin to be adapted to exert a massaging force in a direction perpendicular to a lash line to express material from the blocked glands.

9. The method of claim 8, wherein the apparatus is used twice a day for first two weeks followed by a once daily treatment.

10. A massaging bobbin adapted for use with an apparatus having a heater to melt and express material from blocked glands in a mammalian eyelid, said massaging bobbin being substantially concave cylindrical in shape and rotatable by a motor located in the apparatus and capable of transmitting heat to a mammalian eyelid, the massaging bobbin comprising: a plurality of scrubbing elements having a plurality of elongated projections having a substantially circular cross section, and a plurality of massaging elements comprising a plurality of continuous narrow ridges extending around the massaging bobbin in a generally helical configuration, the plurality of continuous narrow ridges comprising upper and lower ridges, the plurality of scrubbing elements being positioned between the upper and lower ridges, wherein the plurality of massaging elements are configured to be applied in contact with the eyelid and are shaped and positioned on the massaging bobbin and adapted to exert a massaging force in a direction perpendicular to a lash line to express material from the blocked glands.

* * * * *